US006868567B2

(12) United States Patent
Edgerton

(10) Patent No.: US 6,868,567 B2
(45) Date of Patent: Mar. 22, 2005

(54) HEIGHT AND ANGLE ADJUSTABLE BED

(75) Inventor: John Edgerton, Omro, WI (US)

(73) Assignee: GF Health Products, Inc., Atlanta, GA (US)

( * ) Notice: Subject to any disclaimer, the term of this patent is extended or adjusted under 35 U.S.C. 154(b) by 13 days.

(21) Appl. No.: 10/623,980

(22) Filed: Jul. 21, 2003

(65) Prior Publication Data

US 2004/0055087 A1 Mar. 25, 2004

Related U.S. Application Data

(60) Provisional application No. 60/397,528, filed on Jul. 19, 2002.

(51) Int. Cl.[7] ..... A47B 7/00

(52) U.S. Cl. ..... 5/611; 5/600; 5/610; 5/616; 5/620; 5/627; 5/86.1

(58) Field of Search ..... 5/600, 610, 611, 5/613, 616–618, 620, 86.1, 625, 627

(56) References Cited

U.S. PATENT DOCUMENTS

| | | | | |
|---|---|---|---|---|
| 4,097,939 | A | 7/1978 | Peck et al. | 5/63 |
| 4,592,104 | A | 6/1986 | Foster et al. | 5/66 |
| 4,751,754 | A | 6/1988 | Bailey et al. | 5/68 |
| 4,894,876 | A | 1/1990 | Fenwick | 5/60 |
| 4,985,946 | A | 1/1991 | Foster et al. | 5/60 |
| 5,054,141 | A | 10/1991 | Foster et al. | 5/63 |
| 5,148,562 | A | 9/1992 | Borders et al. | 5/610 |
| 6,016,580 | A | 1/2000 | Heimbrock et al. | 5/86.1 |
| 6,363,556 | B1 | 4/2002 | Krauska et al. | 5/618 |
| 6,405,393 | B2 | 6/2002 | Megown | 5/611 |
| 6,421,854 | B1 | 7/2002 | Heimbrock | 5/610 |
| 2002/0066142 | A1 * | 6/2002 | Osborne et al. | 5/600 |
| 2002/0148044 | A1 * | 10/2002 | Hayes et al. | 5/618 |
| 2003/0159215 | A1 * | 8/2003 | Shiery et al. | 5/600 |
| 2003/0208847 | A1 * | 11/2003 | Vrzalik et al. | 5/713 |
| 2004/0128766 | A1 * | 7/2004 | Freeborn et al. | 5/611 |

* cited by examiner

*Primary Examiner*—Teri Pham Luu
(74) *Attorney, Agent, or Firm*—Pitney Hardin LLP

(57) ABSTRACT

A height adjustable bed includes a sliding hinge mechanism for attaching each of two articulated supports to wheeled bases. A linear actuator is connected between an actuating frame that is attached to each of the articulated supports and a horizontal linkage member that is attached to each of the articulated supports. Extension of the linear actuator raises the bed from a low position with assistance of a mechanical advantage provided by a fulcrum between the articulated support and the actuating frame that results from displacement of downward forces from the sliding hinge to the actuating frame.

18 Claims, 16 Drawing Sheets

HEIGHT AND ANGLE ADJUSTABLE BED

RELATED APPLICATION

This application claims the benefit of U.S. Provisional Application No. 60/397,528, entitled "MECHANISM FOR RAISING AND LOWERING AN ARTICULATING BED," to John Edgerton, which was filed on Jul. 19, 2002, the entire disclosure of which is incorporated by reference herein.

FIELD OF THE INVENTION

The field of the invention is height and angle adjustable hospital beds.

BACKGROUND OF THE INVENTION

Typically, height and angle adjustable beds are used by medical institutions, such as hospitals and nursing homes, and usually include a bed frame and an articulating mechanism for lowering the bed frame to a low position so that it may be lifted and carried like a stretcher, and a high position so that it may be used as a gurney.

However, there is a longstanding and unresolved need for a height and angle adjustable bed having a robust and responsive articulated mechanism that can rapidly raise and lower a bed between a fully depressed and a fully raised position.

SUMMARY OF THE INVENTION

A height and angle adjustable bed comprises a frame and an articulated mechanism for raising and lowering the bed frame between a lower position resting on at least one wheeled base and a raised position. In one embodiment, a single linear actuator is responsible for raising and lowering the height and angle adjustable bed. One or more additional linear actuators, which do not raise and lower the bed, may be added to adjust the angle of a mattress that is supported by the bed frame.

DETAILED DESCRIPTION OF THE FIGURES

Figure 1:
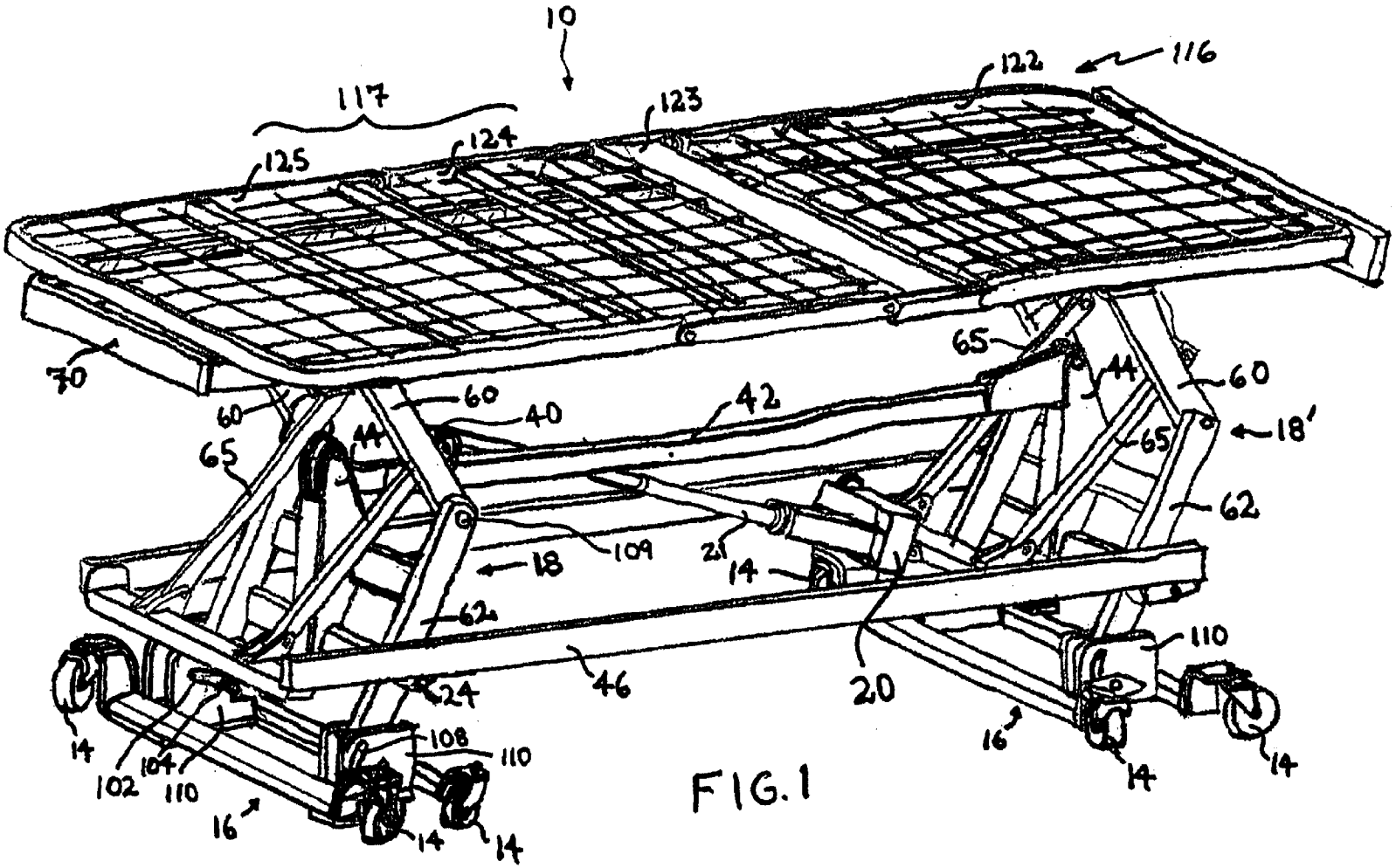
FIG. 1 is a perspective view of an articulating bed according to an embodiment of the present invention.

FIG. 1 shows a height and angle adjustable bed 10 according to an embodiment of the present invention. The height and angle adjustable bed 10 includes a bed frame 70, wheels 14 mounted on respective bases 16, and a mechanism that raises bed frame 70 from any lower position to a higher position and lowers bed frame 70 from any higher position to any lower position.

Figure 2:
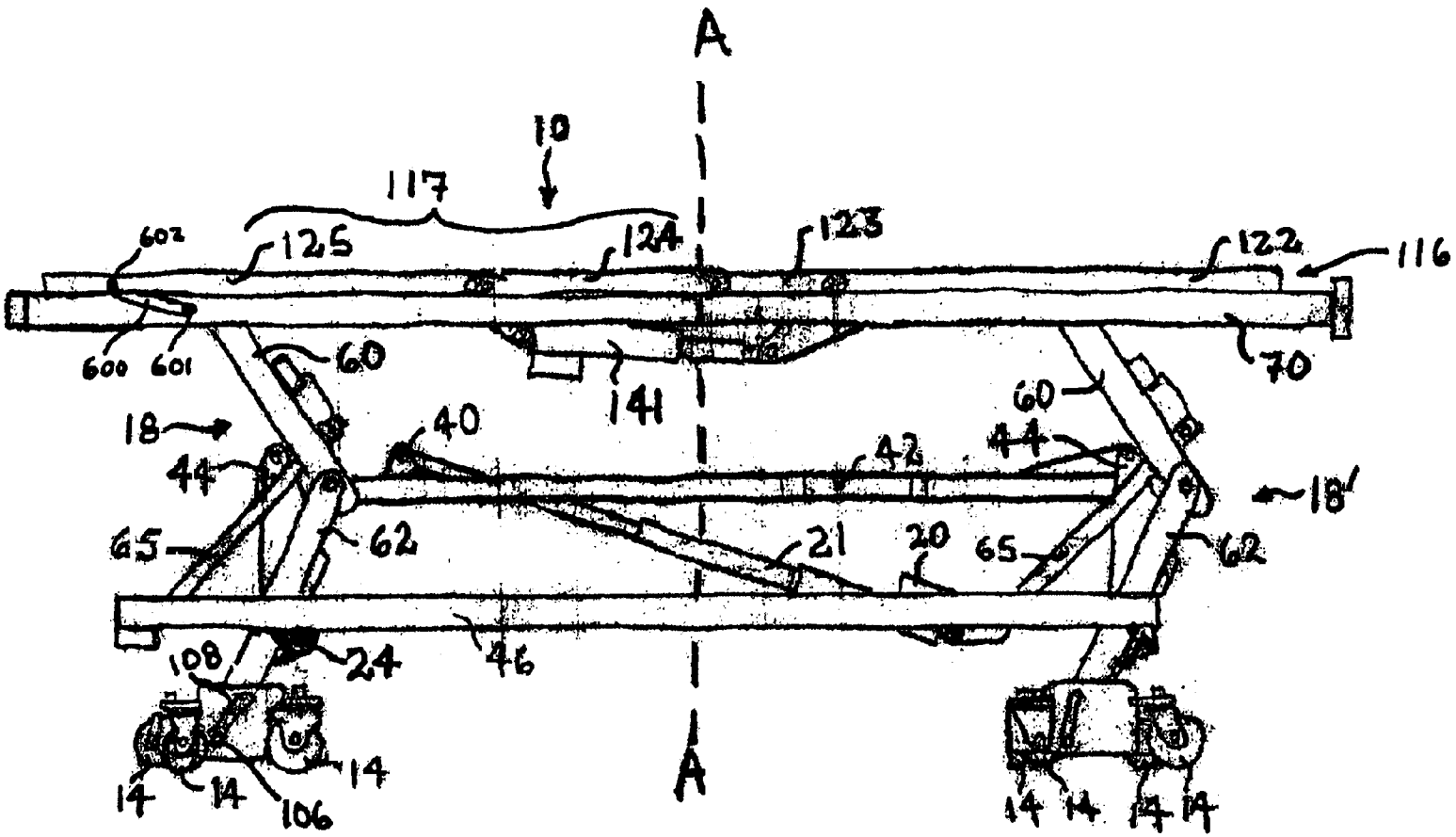
FIG. 2 is a side plan view of the articulating bed according to an embodiment of the present invention in its highest position.

FIG. 2 shows a side plan view of the bed 10. The mechanism for lowering and raising the bed frame 70 includes a system of levers and joints, such as the two identical articulated supports 18, 18' as shown on the left and right side of line A—A in FIG. 2, respectively. According to one embodiment, these two articulated supports 18, 18' are identical, reducing the total part count of the bed 10. Each of the articulated supports 18, 18' comprise an upper support 60 articulatedly joined to a lower support 62, for example. The articulated supports are adjusted by a single motor 20 that drives a linear actuator 21 to raise and lower the bed frame 70. The arrangement of elements used in each system of levers and joints enables a single motor 20, such as an electric motor, to lower or raise bed frame 70 without assistance of a spring, sealed piston or other energy storing system.

Figure 3:
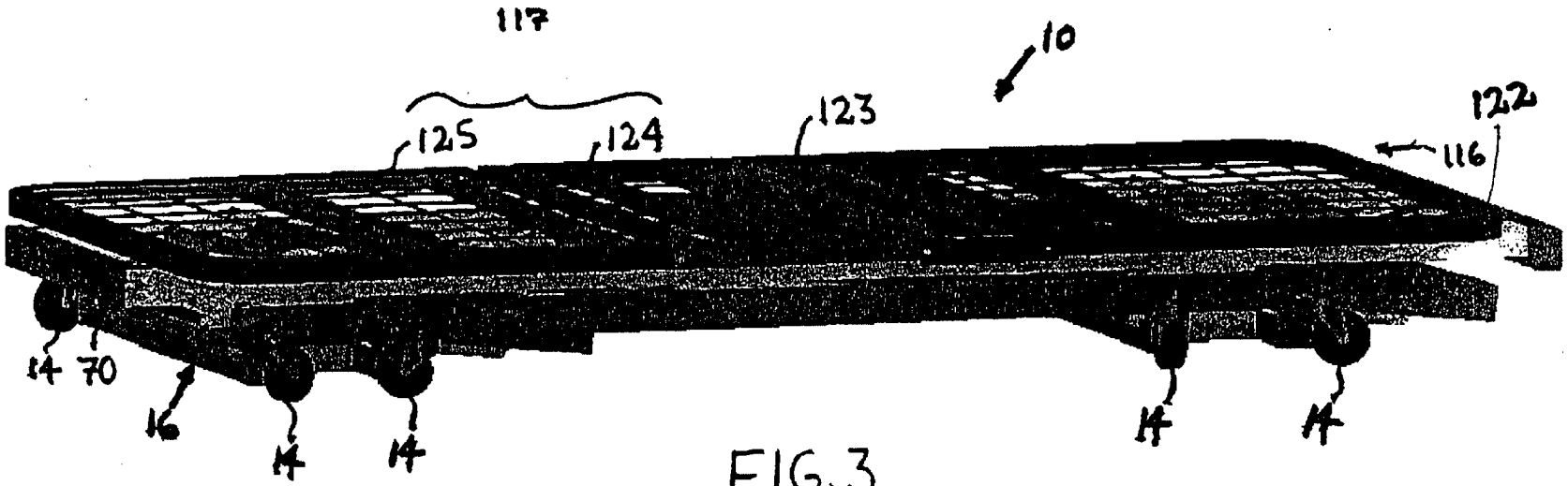
FIG. 3 is a perspective view of the articulating bed according to the present invention in its lowest position.

FIG. 3 shows the bed 10 of FIG. 2 in its lowest position. The articulated supports 18, 18' and four sliding hinges 110 that join the articulated supports 18, 18' to the wheeled bases 16 allow the bed 10 to be lowered to a position that is fully depressed, such that the bed frame 70 rests directly atop the wheeled bases 16, as shown in FIG. 3. An articulated mattress support 116 comprises a head assembly 122, a central assembly 123, and a foot assembly 117. The central assembly 123 is attached to the bed frame 70, for example. The foot assembly 117 is articulated, having a lower mattress support 125 and a middle mattress support 124 that are joined articulatedly to the central assembly 123.

Figure 4:
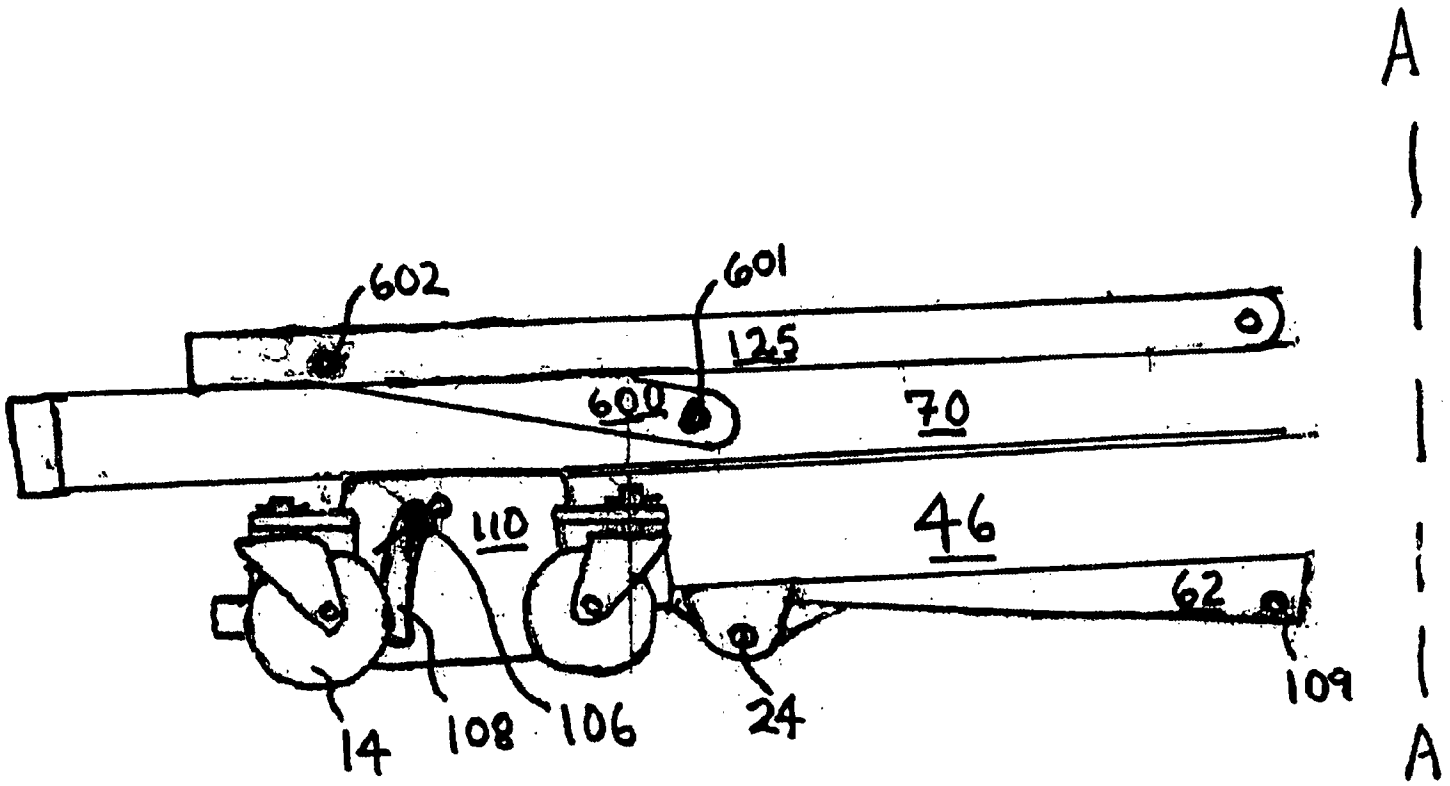
FIG. 4 shows an enlarged side plan view of the foot of the articulating bed in its lowest position.

FIG. 4 shows the foot portion of bed 10 in its lowest position. The lower supports 62 are positioned below the top of the wheels 14 in the fully depressed position. This allows bed frame 70 to be lowered below the position that could be reached by conventional articulating beds.

Figure 5:
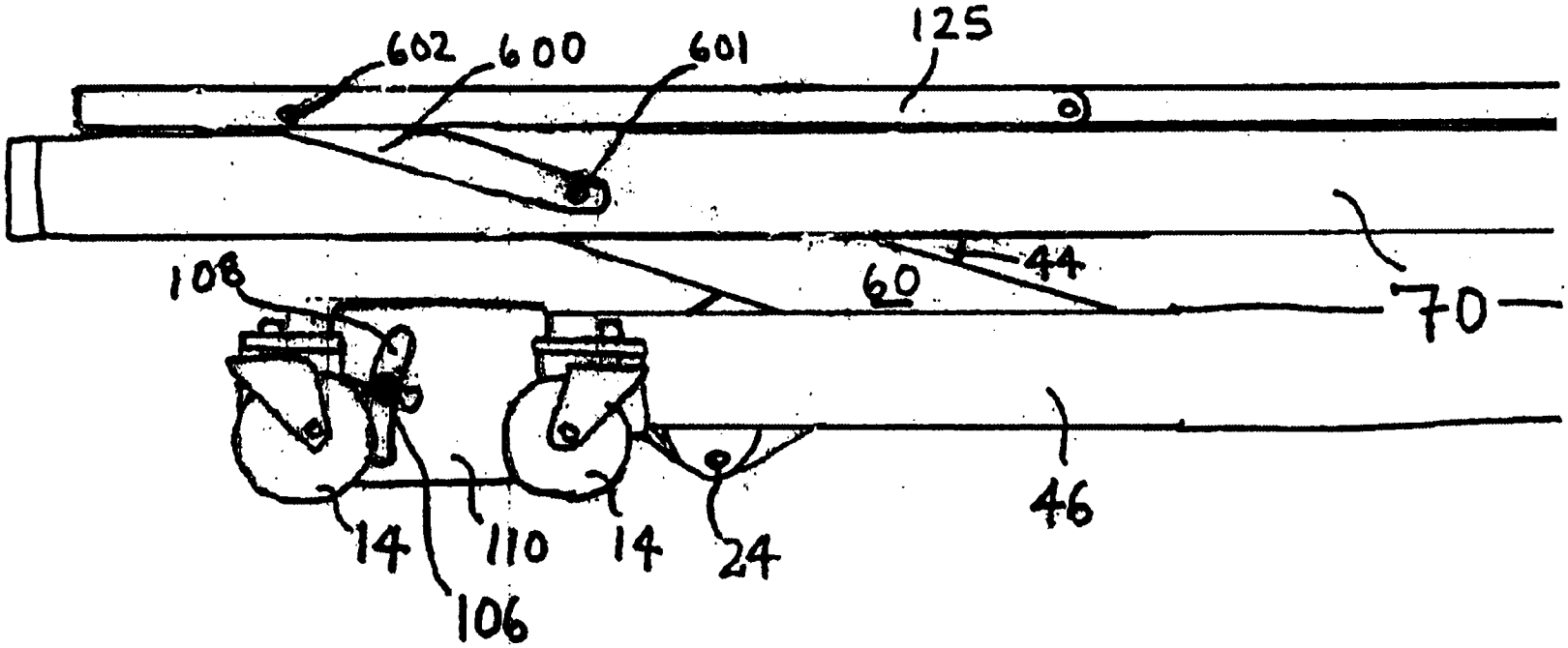
FIG. 5 shows an enlarged side plan view of the foot of the articulating bed in an intermediate position between the lowest position and the highest position.
Figure 6:
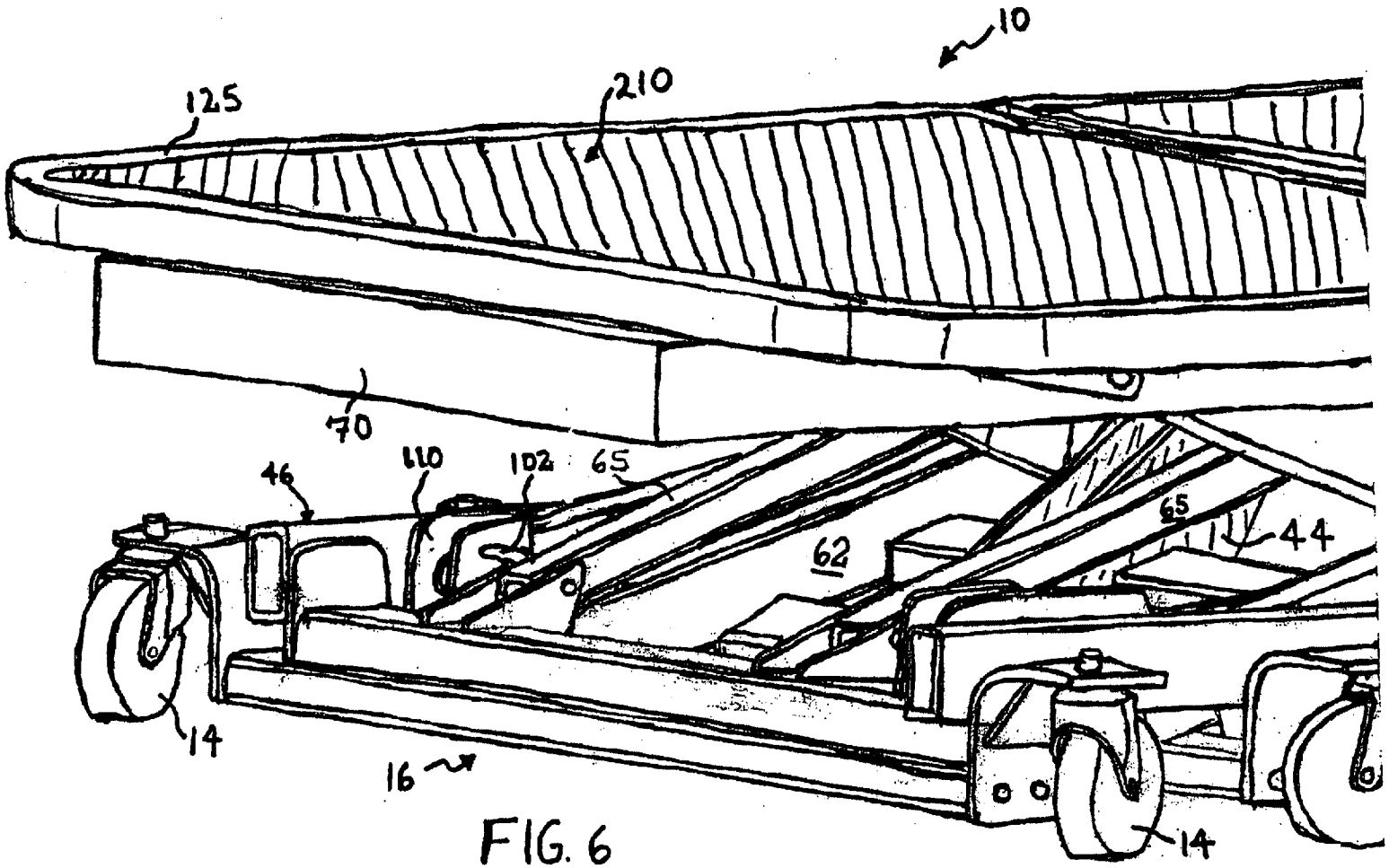
FIG. 6 shows an enlarged perspective view of the foot of the articulating bed in another intermediate position between the lowest position and the highest position.
Figure 7:
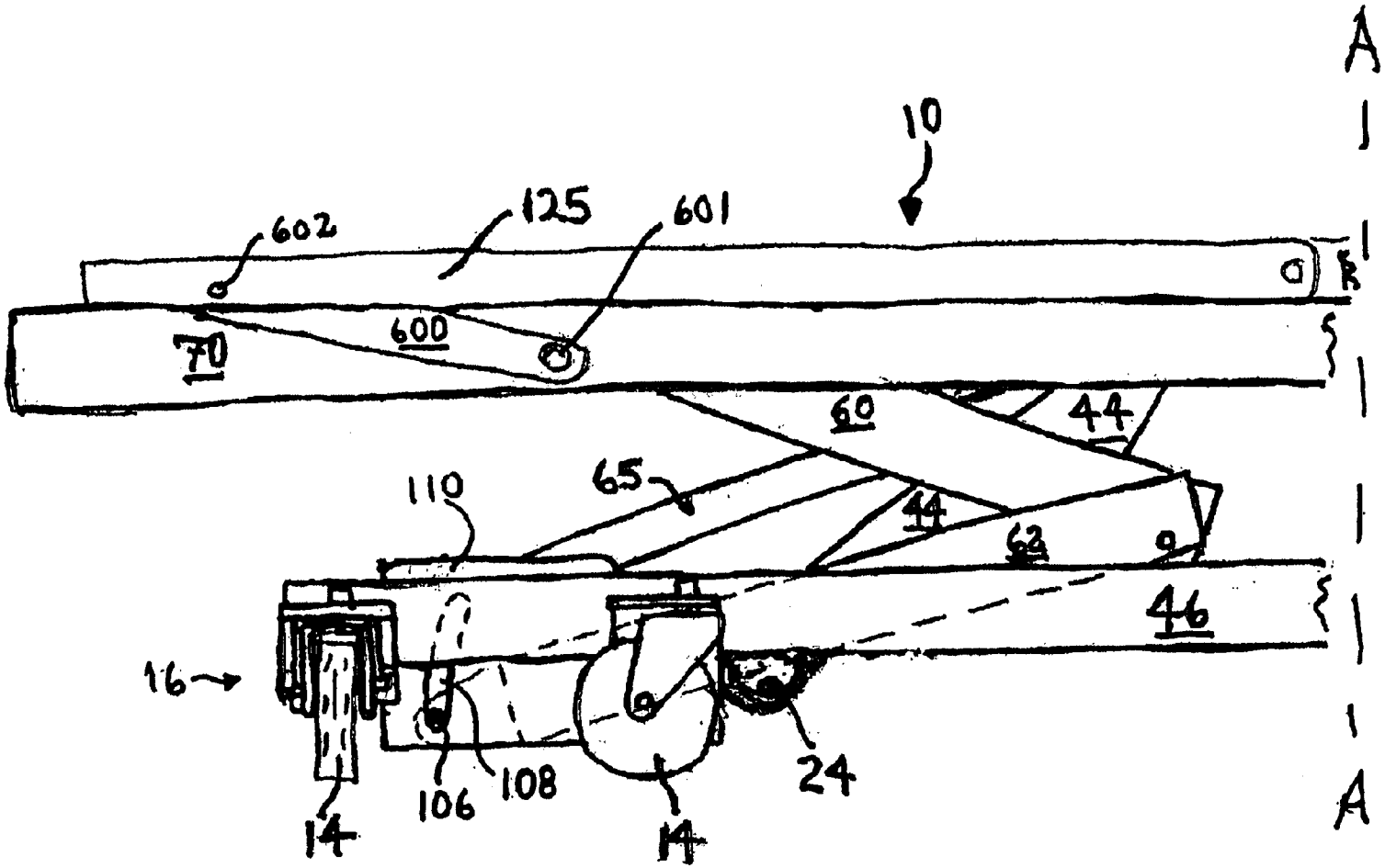
FIG. 7 shows an enlarged side plan view of the foot of the articulating bed in the position shown in FIG. 6, showing some hidden details.
Figure 10:
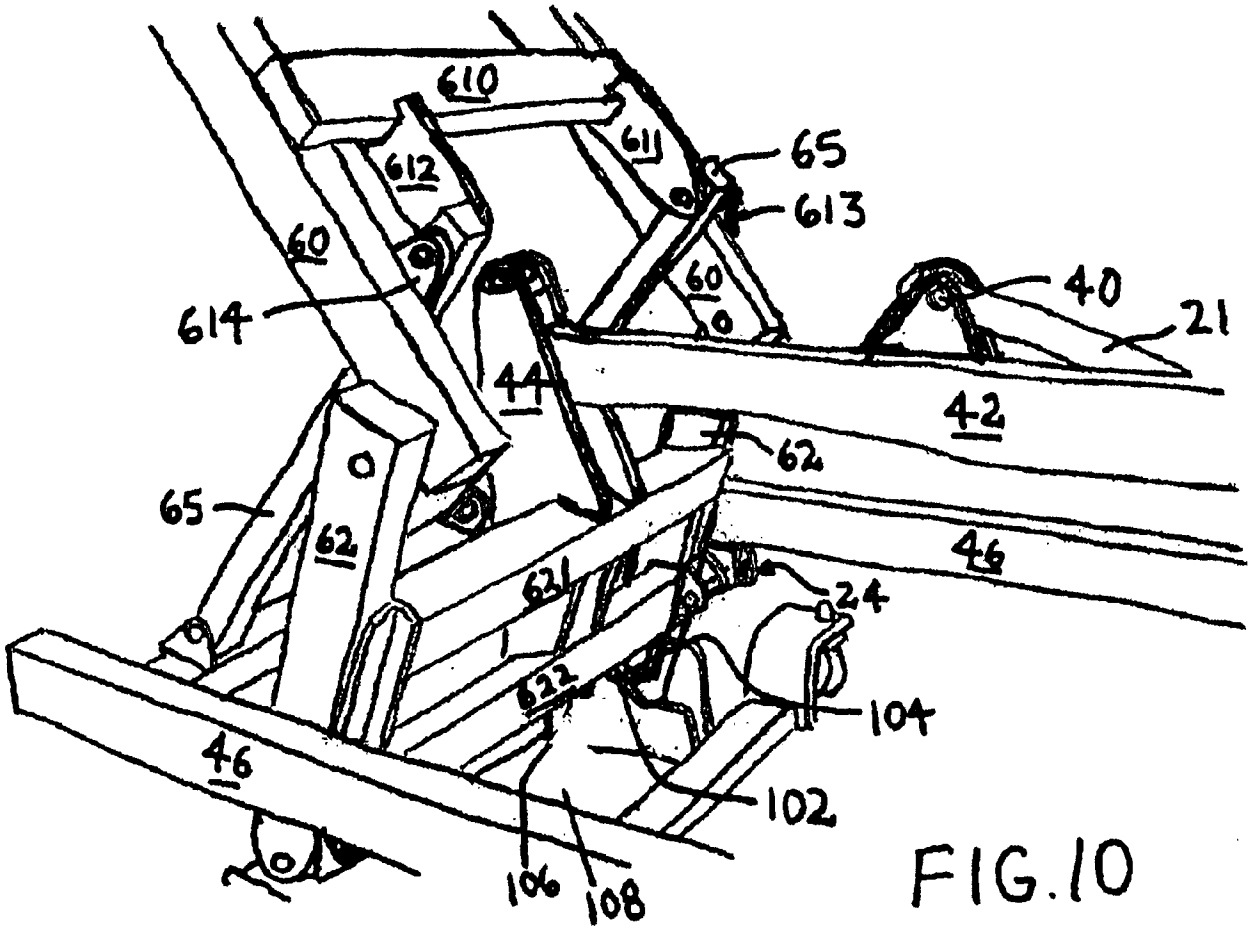
FIG. 10 shows an enlarged perspective view of an articulated support.

Referring to FIGS. 4–8, the following occurs when the bed frame 70 is raised from its lowest position. The lower supports 62 pivot about respective fulcrum points 24. As can be seen in FIG. 4, each lower support 62 includes a guide pin 106 at its distal end. The guide pin 106 is fitted in an arcuate slot 108 which is formed in each sliding hinge 110. When the lower support 62 is pivoted about the fulcrum point 24 in its lowered position, the guide pin 106 slides within the arcuate slot 108 from one terminal end of the arcuate slot 108 toward another opposing terminal end. As shown in FIG. 5, this raises the bed frame 70. Once the guide pin 106 reaches the opposing terminal end of the arcuate slot 108, lower support 62 and bed frame 70 have been lifted to an intermediate position as shown by FIGS. 6 and 7, which is referred to herein as the transition point. In FIG. 7, the dashed lines show features of the slot 106 and lower support 62 that are hidden from view. The fulcrum point 24 pivotably attaches the lower support 62 to an actuating frame 46, as shown in FIG. 10, for example.

As shown in FIGS. 4–7, the actuating frame 46 remains at rest until the bed frame 70 raises to the transition point.

Figure 8:
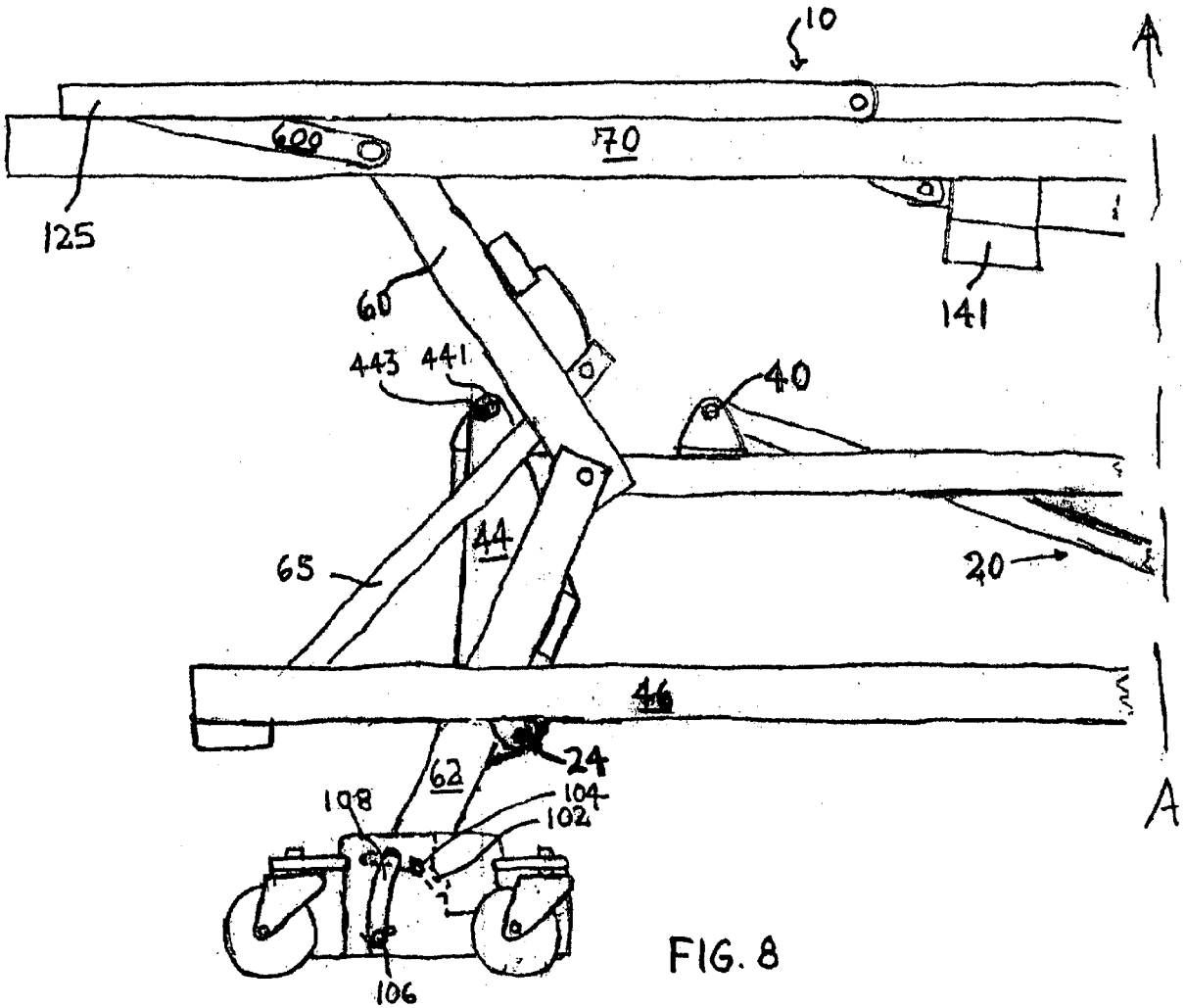
FIG. 8 shows an enlarged side plan view of the foot of an articulating bed in its highest position.

Thereafter, the lower support 62 continues to pivot about guide pin 106, but the guide pin 106 does not translate in the arcuate slot 108. Upon further raising, the actuating frame 46 raises above the base 16, and the force of lifting the bed shifts to guide pin 106, while the lower support 62 continues to pivot about the fulcrum point 24 as shown in FIG. 8, which shows the highest position of the bed 10. Shifting the point of downward force from the fulcrum point 24 to the guide pin 106 increases the throw of the lower support 62, which increases the rate of movement of the bed frame 70 compared to the rate of movement prior to reaching the transition point.

Figure 9:
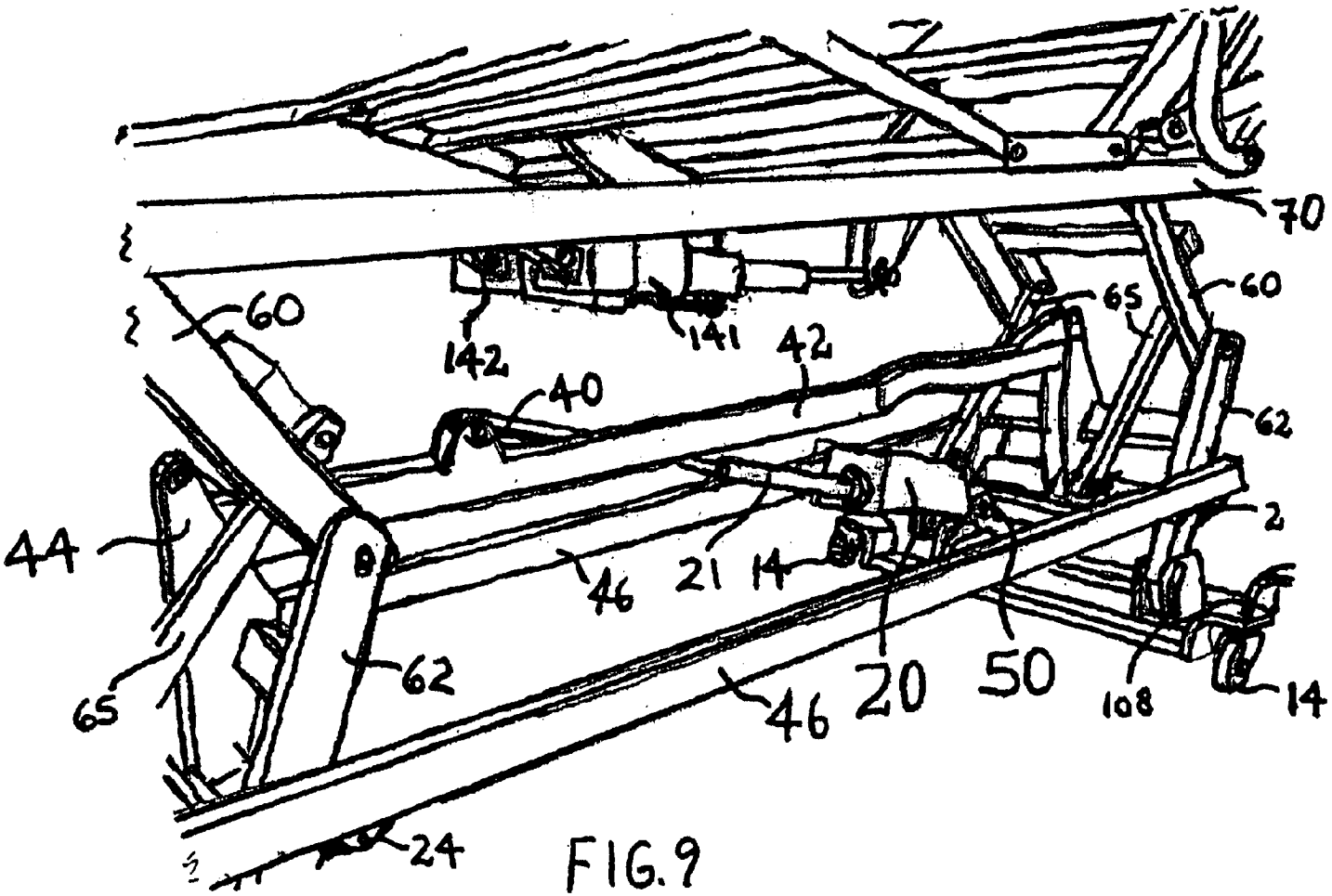
FIG. 9 shows an enlarged view of the mechanism for adjusting the height and angle of the articulating bed.

FIG. 9 shows a detailed view of one embodiment having a linear actuator 21. The linear actuator 21 is attached removably at one end 50 to a crossmember of the actuating frame 46 and at an opposite end 40 to a horizontal linkage member 42. The horizontal linkage member has two opposite ends that each connect to one of two brackets 44 that are fixed to the lower supports 62 that are on opposite sides of line A—A as shown in FIG. 2. The brackets 44 act as levers to pivot the lower supports 62 about their respective fulcrum points 24, which raises and lowers the bed 10.

FIG. 10 illustrates an articulated support comprising an upper support 60 joined articulatedly to a lower support 62. Lever arms 65 are pivotably connected at one end to the actuating frame 46 and at the other end to the upper support 60, helping to support upper support 60 during raising and lowering, as the lower support 62 pivots in relation to the actuating member 46. Fulcrum point 24 can be seen from the back side in FIG. 10, for example, which shows the brackets connecting the lower support 62 to the actuating frame 46.

Figure 11:
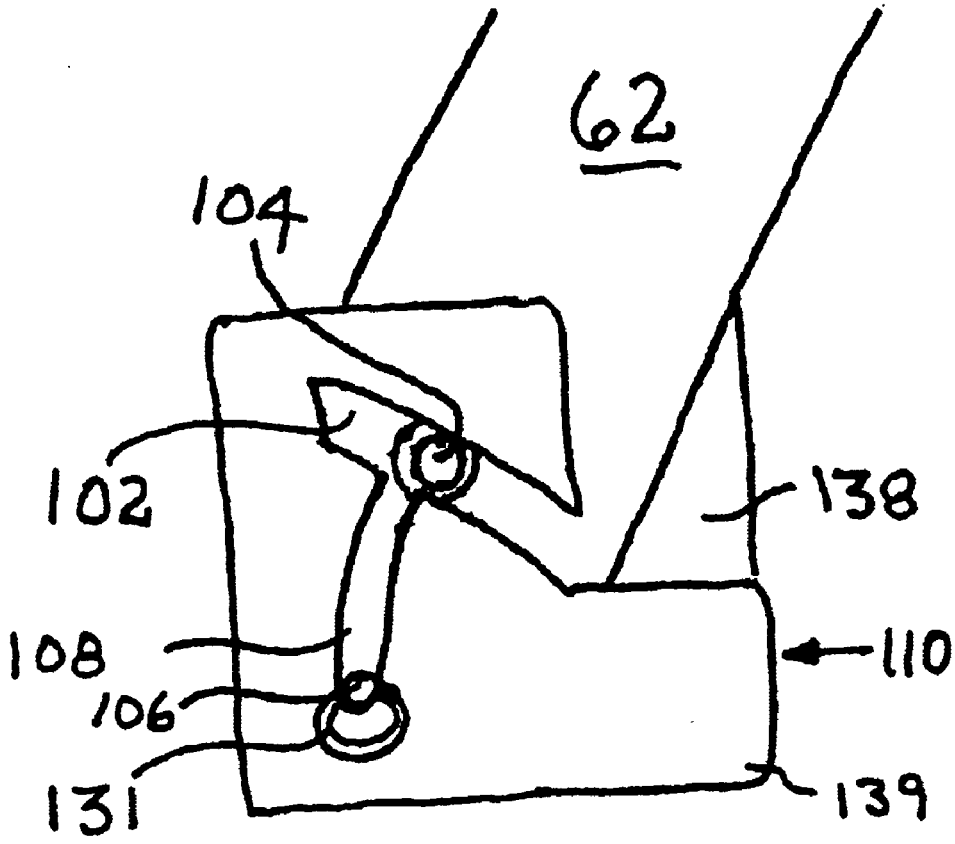
FIG. 11A shows an enlarged side plan view of a sliding hinge in accordance with another embodiment of the invention.

FIG. 11 illustrates one embodiment of a sliding hinge 110. The sliding hinge 110 comprises two plates, an outer plate 138 and an inner plate 139. For example, each plate 138,139 has a first arcuate slot 108 for retaining pin 106 that is retained in a hole in the end of the lower support 62. For example, the pin 106 may be removably inserted through a corresponding hole in the lower support 62. Only a portion of the lower support 62 is shown in FIG. 11. A removable retaining pin or loop 131 is used to retain the pin 106 in the arcuate slot 108 of the sliding hinge 110 shown in FIG. 11.

In one embodiment, a second arcuate slot 102 in the inner plate 139 has an open end, a closed end and a slope different than the first arcuate slot 108. A second pin 104 is retained in the second arcuate slot 102 and connects a different location of the lower support 62 than the pin 106 retained in the first slot. The plates 138, 139, slots 102, 108 and pins 104, 106 are configured such that the second arcuate slot 102 and the second pin 104 act as a stabilizing device for the articulated supports 18, 18' during raising and lowering when the bed is above the transition point. When the bed is below the transition point, the second pin 104 may move freely outside of the open end of the arcuate slot 102. Thus, the first pin 106 is allowed to translate in the first arcuate slot 108 during raising and lowering only when the actuating frame 46 is resting on the castor base 16. The second pin 104 translates within the second slot 102 during raising and lowering only when weight is shifted to the first pin 106, when it is stationary at the end of the first arcuate slot 108. Then, when the bed is above the transition point, the second pin 104 translates in the second arcuate slot in a circular arc with the first pin 106 at the center of its circular arc, for example. This stabilizes the bed by preventing the first pin 106 from translating in the first slot 108, when the actuating frame is no longer resting on the castor bases 16.

Figure 13A:
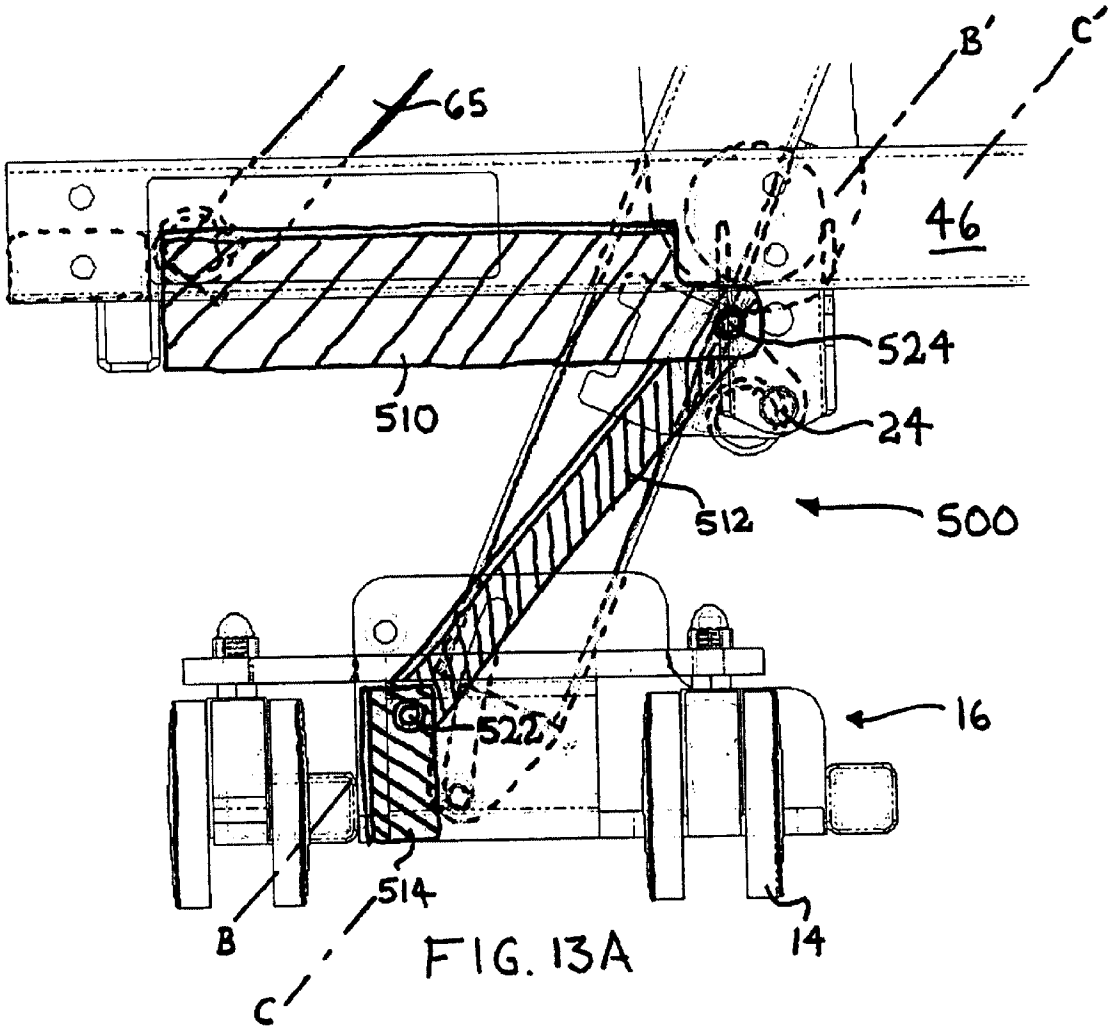
FIGS. 13A–13C illustrate an alternative embodiment.
Figure 13B:
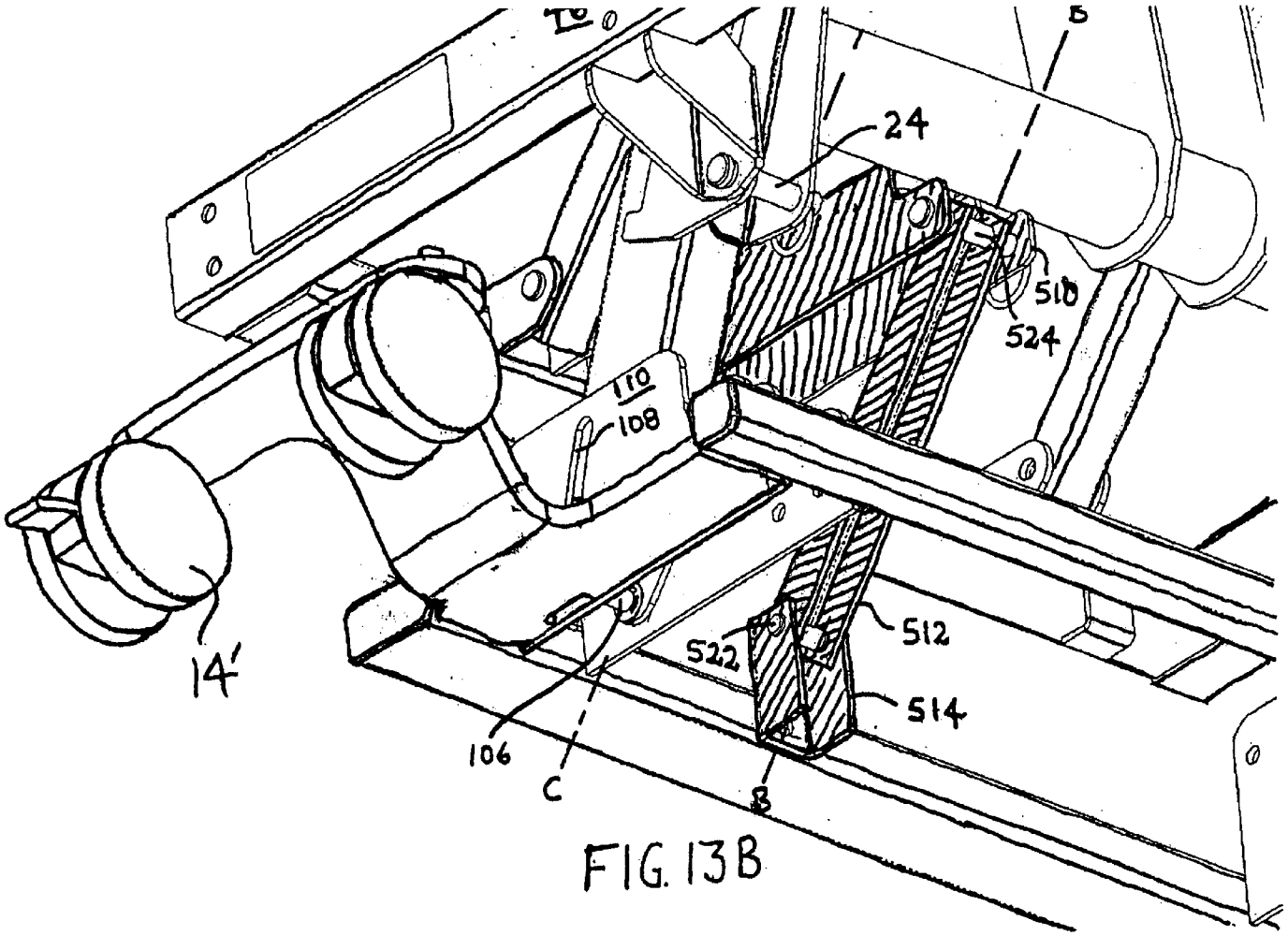
Figure 13C:
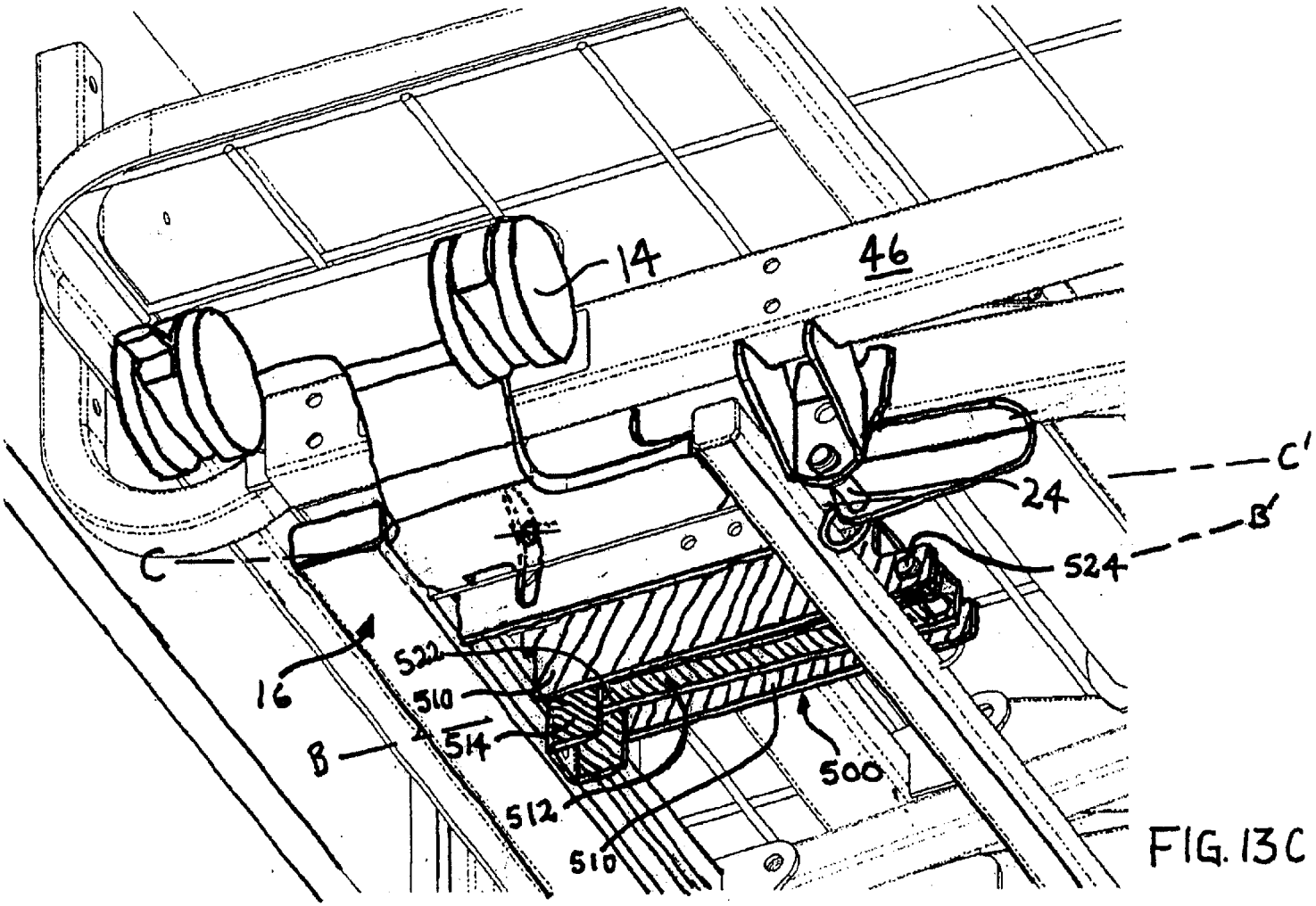
Figure 14:
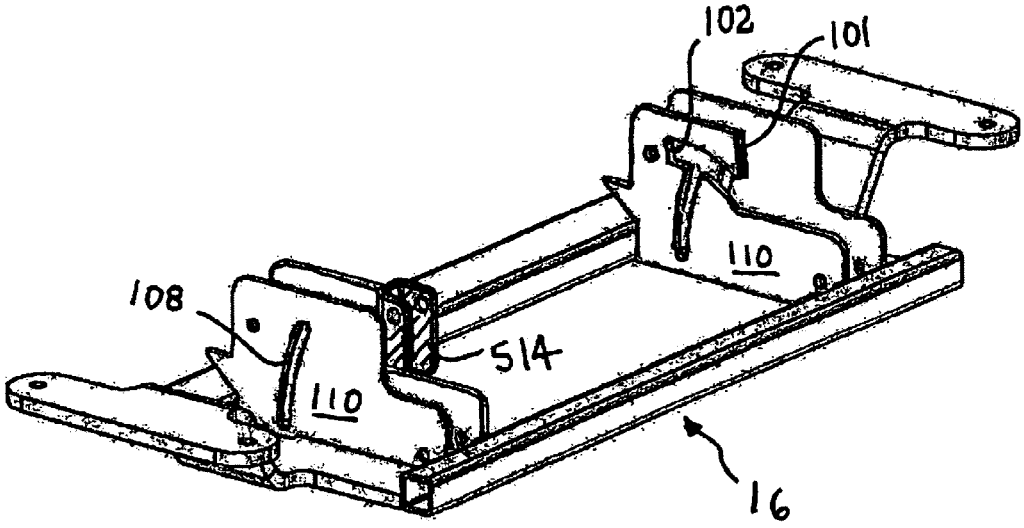
FIG. 14 shows a detailed perspective view of one embodiment of a castor base frame.

In FIGS. 13A–13C, another stabilizing device is shown. The shaded structure in FIG. 13A is normally partially hidden in a side plan view, but is shown here for clarity. Actuating guide 500 comprises an actuating bracket 510 attached to the actuating frame 46 at one end and pivotably attached to a guiding link 512 at an opposite end 524. Guiding link 512 pivotably links the opposite end 524 with a base bracket 514 that is mounted on one of the castor bases 16. The base bracket 514 is pivotably attached to the guiding link 512 at a pivot point 522. The distance between the guide pin 106 and the pivot point 522 is constant only at or above the transition point. Below the transition point, as the guide pin 106 translates in the arcuate slot 108, the distance between the guide pin 106 and the pivot point 522 changes. The opposite end 524 of the actuating bracket 510 does not move relative to fulcrum point 524. Thus, imaginary lines B–B' and C–C' drawn through the centers of the opposite end 524 of the actuating bracket and pivot point 522 and through the guide pin 106 and the fulcrum point 524, respectively, form a pair of parallel lines in all positions of the bed 10 from the transition point to the highest raised position. For example, FIGS. 13B and 13C show a perspective view of the bed 10 at its highest point and below the transition point, respectively. Below the transition point, the guide pin 106 starts moving in the arcuate slot 106, and lines B–B' and C–C' are no longer parallel. Instead, the imaginary lines are convergent at the B' and C' ends and divergent at the B and C ends of the imaginary lines.

The embodiment shown in FIGS. 13A–13C need not have a second arcuate slot 102 that has a slope different than the first arcuate slot 108. Instead, the second plate of the sliding hinge 110 may be identical to the first plate, reducing the part count of the bed 10. In this case, a plurality of guiding links may be added to one or both of the castor bases 16. Alternatively, both stabilizing devices may be used, further improving stability of the castor base 16. FIG. 4 shows an embodiment of a castor base 16 (frame only with castors not shown) having both a base bracket 514 for a guiding link and a second arcuate slot 102.

In one embodiment, a mattress support assembly 116 comprises a head assembly 122 pivotably attached to a central assembly 123, which is fixed to the bed frame 70, as shown in FIG. 2. An articulated foot assembly 117 comprises a lower support 125 articulatedly joined to the bed frame 70 by a mattress frame linkage member 600 and articulatedly joined to a middle support 124, which is pivotably attached to the central assembly 123.

As shown in FIG. 9, two adjunct linear actuators 141, 142 raise and lower the mattress support frame 116, which is comprised of a head assembly 122 joined to a central assembly 123 and joined to a foot assembly 117. The foot assembly 117 is articulated. The articulated foot assembly 117 is comprised of a middle support 124 joined to a lower support 125. The middle support 124 is pivotably connected to one of the two adjunct linear actuators 142. The head assembly 122 is pivotably joined to the other of the two adjunct linear actuators 141. Thus, the angle of the foot assembly 117 and the angle of the foot assembly 117 are independently adjustable by the two adjunct linear actuators 141, 142 which are connected to the support frame 70. For example, the two adjunct linear actuators 141, 142 are removably connected in a side-by-side arrangement, as shown in FIG. 9.

Figure 12:
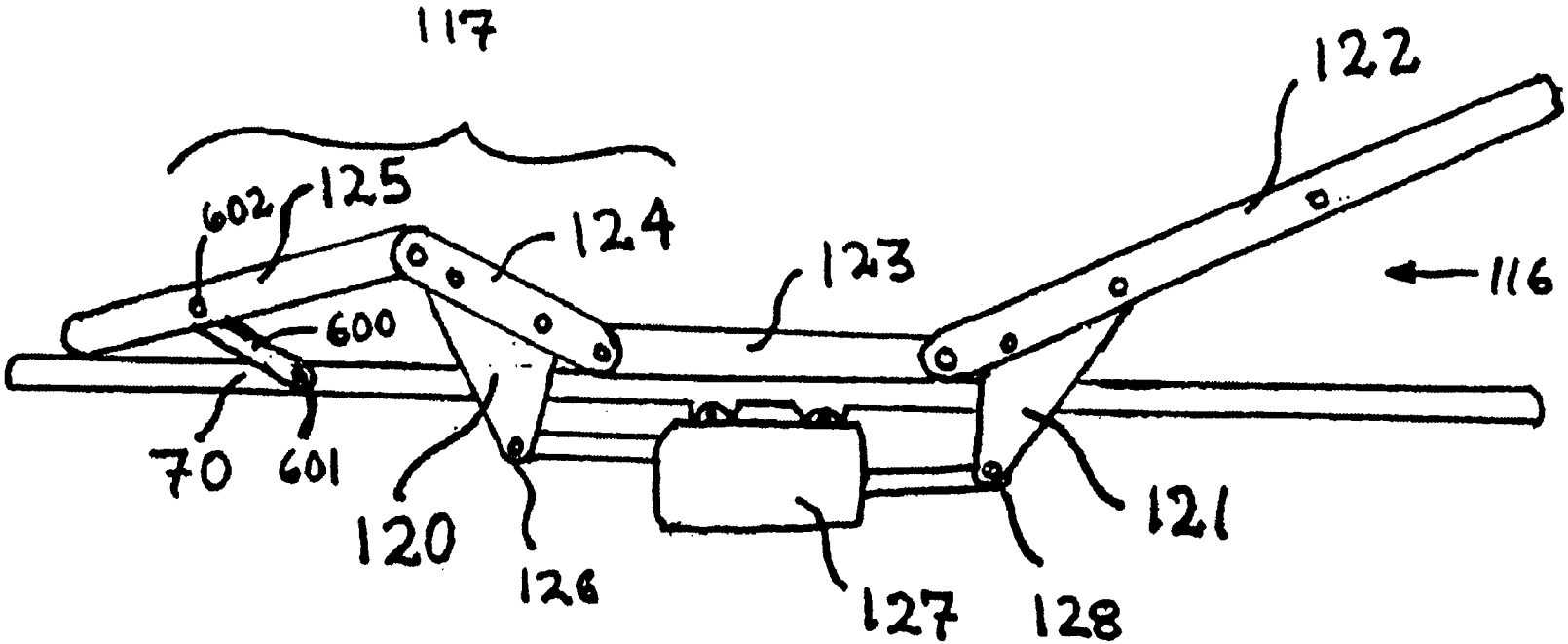

In an alternative embodiment, the angle of the mattress support assembly 116 is adjusted by a colinear actuator 127 pivotably attached at a first end 126 and a second end 128, which is opposite of the first end 126 as shown in FIG. 12. The first end 126 is attached to the middle support 124 by a bracket 120. The second end 128 is attached to the head assembly 122 by a second bracket 121. The first and second brackets 120, 121 act as levers to adjust the angle of the foot assembly 117 and the head assembly 122.

The colinear actuator 127 may be configured such that the first end 126 and the second end 128 move independently. Thus, the angle of the head assembly 122 and the middle support 124 are independently adjustable. A colinear actuator 127 is a unitary package; however, the unitary package may comprise either one motor or a plurality of motors. The first and second ends 126, 128 may be aligned in a single line or may be offset, as shown in FIG. 12. In one embodiment, the colinear actuators are aligned and operate together to adjust the angle of the head assembly 122 in unison with the foot assembly 117, simplifying control of mattress support adjustments.

As shown in the embodiment of FIG. 12, the angle of the lower mattress support 125 is determined by the angle imparted to the middle support 124. A mattress linkage member 600 is pivotably attached at one end 602 to the lower mattress support 125 and at its opposite end 601 to the bed frame 70, helping to stabilize the position of the lower mattress support 125.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A height adjustable bed comprising:

a bed frame including a head portion and a foot portion;

a first articulated support pivotably connected to the head portion of the bed frame, and a second articulated support pivotably connected to the foot portion of the bed frame, the first and second articulated supports each comprising an upper support joined articulatedly to a lower support;

a first sliding hinge and a second sliding hinge each comprising at least one arcuate slot and at least one pin retained in the slot, the at least one pin of each of the first sliding hinge and the second sliding hinge being connected to the lower supports of the first articulated support and the second articulated support, respectively, such that the at least one pin is capable of translating and pivoting;

a first wheeled base connected to the lower support of the first articulated support by the first sliding hinge;

a second wheeled base connected to the lower support of the second articulated support by the second sliding hinge;

a linkage member pivotably connected on one end to the first articulated support and on the other end to the second articulated support;

a linear actuator having a first end and a second end, pivotably connected on the first end to the linkage member, the linear actuator being capable of extension and retraction; and an actuating frame pivotably connected to the second end of the linear actuator and pivotably connected to the first articulated support at a first fulcrum point and the second articulated support at a second fulcrum point, wherein extension and retraction of the linear actuator raises and lowers the bed frame and during raising and lowering the at least one pin of each of the first sliding hinge and the second sliding hinge in one range of intermediate positions, is translating and in another range of intermediate positions, is not translating.

2. The height adjustable bed of claim 1, wherein the first articulated support and the second articulated support are identical.

3. The height adjustable bed of claim 1, wherein the linear actuator is removably connected.

4. The height adjustable bed of claim 1, further comprising at least one linear arm pivotably connected at one end to the actuating frame and at an opposite end to the upper support, wherein the upper support is pivoted in relation to the actuating frame as the linear actuator extends or retracts.

5. The height adjustable bed of claim 1, wherein each sliding hinge further comprises a first plate and a second plate, each of the first plate and the second plate having a first arcuate slot for retaining a first pin connecting each sliding hinge to a respective lower support of one of the first articulated support and the second articulated support, the second plate having a second arcuate slot for retaining a second pin, the second arcuate slot comprising an open end and a closed end opposite of the open end, the first plate, the second plate, the first pin and the second pin being configured such that the first pin in the first arcuate slot translates in one range of intermediate positions, and the second pin in the second arcuate slot translates in a circular arc around the first pin in another range of intermediate positions, when the first pin is stationary.

6. A height and angle adjustable bed comprising:

a bed frame including at least one longitudinal framing member, a first transverse framing member at a head portion of the bed frame and a second transverse framing member at a foot portion of the bed frame;

a first articulated support pivotably connected to the head portion of the bed frame, and a second articulated support pivotably connected to the foot portion of the bed frame, the first and second articulated supports each comprising an upper support joined articulatedly to a lower support;

a first sliding hinge and a second sliding hinge each comprising an arcuate slot and at least one pin retained in the slot, the at least one pin of each of the first sliding hinge and the second sliding hinge being connected to the lower supports of the first articulated support and the second articulated support, respectively, such that the at least one pin is capable of translating and pivoting;

a first wheeled base connected to the first articulated support by the first sliding hinge;

a second wheeled base connected to the second articulated support by the second sliding hinge;

a linkage member pivotably connected on one end to the first articulated support and on the other end to the second articulated support;

a linear actuator having a first end and a second end, pivotably connected on the first end to the linkage member, the linear actuator being capable of extension and retraction;

an actuating frame pivotably connected to the second end of the linear actuator and pivotably connected to the first articulated support at a first fulcrum point and the second articulated support at a second fulcrum point, such that extension and retraction of the linear actuator raises and lowers the bed frame and such that during raising and lowering of bed frame the at least one pin of each of the first sliding hinge and the second sliding hinge, in one range of intermediate positions, is translating and, in another range of intermediate positions, is not translating; and an articulated mattress frame supported by the bed frame, the articulated mattress frame including a head assembly, a foot assembly and a central assembly, the central assembly attaching the head assembly to the foot assembly articulatedly, wherein the articulated mattress frame is supported by the bed frame.

7. The height and angle adjustable bed of claim 6, further comprising a colinear actuator having a central portion, a first end and a second end opposite of the first end of the colinear actuator, wherein the central portion of the colinear actuator is attached to the bed frame, the first end is pivotably attached to the head assembly and the opposite end is pivotably attached to the foot assembly.

8. The height and angle adjustable bed of claim 6, further comprising a first adjunct linear actuator and a second adjunct linear actuator, each having a first end and an opposite end, wherein the first end of each adjunct linear actuator is connected to the bed frame and the second end of the first adjunct linear actuator is pivotably attached to the head assembly and the second end of the second adjunct linear actuator is pivotably attached to the central assembly.

9. The height and angle adjustable bed of claim 8, further comprising a first bracket fixedly attached to the head assembly and a second bracket fixedly attached to the foot assembly, wherein the first bracket functions as an attachment point for the first adjunct linear actuator for adjusting the angle of the head assembly in relation to the central assembly, and the second bracket functions as an attachment point for the second adjunct linear actuator.

10. The height and angle adjustable bed of claim 9, wherein the foot assembly comprises a lower mattress support articulatedly joined to a middle mattress support that is pivotably attached to the central assembly and the second bracket is fixed to the middle mattress support such that the second adjunct linear actuator is capable of adjusting the angle of the middle mattress support in relation to both the central assembly and the lower mattress support.

11. A height adjustable bed comprising:

a bed frame including a head portion and a foot portion;

a first articulated support pivotably connected to the head portion of the bed frame, and a second articulated support pivotably connected to the foot portion of the bed frame, the first and second articulated supports each comprising an upper support joined articulatedly to a lower support;

a first sliding hinge and a second sliding hinge;

a first wheeled base connected to the lower support of the first articulated support by the first sliding hinge;

a second wheeled base connected to the lower support of the second articulated support by the second sliding hinge;

a linkage member pivotably connected on one end to the first articulated support and on the other end to the second articulated support;

a linear actuator having a first end and a second end, pivotably connected on the first end to the horizontal linkage member, the linear actuator being capable of extension and retraction; and an actuating frame pivotably connected to the second end of the linear actuator and pivotably connected to the first articulated support and the second articulated support;

wherein extension and retraction of the linear actuator raises and lowers the bed frame and during raising of the bed frame from a low position to a high position the bed reaches a transition point and forces acting downward on the first articulated support and the second articulated support are applied to the first sliding hinge and the second sliding hinge, when the bed is raised above the transition point, and as the bed is lowered from the high position, the actuating frame contacts the first wheeled base and the second wheeled base when the bed reaches the transition point and the forces acting downward are shifted away from the first sliding hinge and the second sliding hinge to the actuating frame when the bed is below the transition point.

12. The bed of claim 11, wherein the forces acting downward are shifted from the first sliding hinge to the first fulcrum point and from the second sliding hinge to the second fulcrum point, when the bed is lowered below the transition point, whereby a mechanical advantage is obtained.

13. The bed of claim 11, further comprising a third sliding hinge attached at an opposite side of the first wheeled base from the first sliding hinge and a fourth sliding hinge attached at an opposite side of the second wheeled base from the second sliding hinge.

14. The bed of claim 11, further comprising a stabilizing device, wherein the stabilizing device connects the actuating frame to one of the first wheeled base and the second wheeled base such that the bed is stabilized above the transition point.

15. The bed of claim 14, wherein the first sliding hinge and the second sliding hinge each comprises:

a first plate and a second plate, each plate having a first arcuate slot for retaining a first pin, each first pin connecting the first sliding hinge and the second sliding hinge to the lower support of the first articulated support and the second articulated support, respectively; and the second plate including a second arcuate slot for retaining a second pin, each second pin connecting the first sliding hinge and the second sliding hinge to the lower support of the first articulated support and the second articulated support, respectively, the first plate and the second plate of each sliding hinge being configured such that the first pin translates in the first arcuate slot during raising and lowering of the bed below the transition point, and the second pin translates in the second arcuate slot in a circular arc around the first pin during raising and lowering of the bed above the transition point, whereby the second plate acts as the stabilizing device.

16. The bed of claim 14, wherein the stabilizing device comprises a guiding link connecting a first pivot point connected to the actuating frame and a second pivot point connected to the first wheeled base.

17. The bed of claim 16, wherein each of the first sliding hinge comprises at least one plate and the at least one plate retains a pin, the pin connecting the first sliding hinge to the lower support of the first articulated support, the first pivot point and the second pivot point of the guiding link being positioned such that, above the transition point, an imaginary line drawn from a center of rotation of the first pivot point to a center of rotation of the second pivot point is parallel to a second imaginary line drawn from a center of rotation of the pin and a center of rotation of the first fulcrum point.

18. A height adjustable bed comprising:

a bed frame including at least one longitudinal framing member, a first transverse framing member at a head portion of the bed frame and a second transverse member at a foot portion of the bed frame;

a first articulated support pivotably connected to the head portion of the bed frame and including a first upper support articulatedly joined to a first lower support, the first lower support comprising a first support leg and a second support leg, the second support leg of the first lower support being attached to the first support leg of the first lower support by a first cross member;

a second articulated support pivotably connected to the foot portion of the bed frame and including a second upper support articulatedly joined to a second lower support, the second lower support comprising a first support leg and a second support leg, the second support leg of the second lower support being attached to the first support leg of the second lower support by a second cross member;

a first castor base connected to the first support leg of the first lower support by a first sliding hinge and to the second support leg of the first lower support by a second sliding hinge, the first castor base comprising at least two castor wheels connected by a caster base frame;

a second castor base connected to the first support leg of the second lower support by a third sliding hinge and to the second support leg of the second lower support by a fourth sliding hinge, the second castor base comprising at least two castor wheels connected by a castor base frame;

an actuating frame comprising a left longitudinal member and a right longitudinal member connected to the left longitudinal member by at least one transverse member, the left longitudinal member being pivotably connected to the first support leg of the first lower support and to the first support leg of the second lower support, the right longitudinal member being pivotably connected to the second support leg of the first lower support and the second support leg of the second lower support;

a linear actuator having a first end and a second end, being pivotably connected at the first end to a linkage member that is pivotably connected on one end to the first articulated support and on another end to the second articulated support, and the linear actuator being pivotably connected at the second end to one of the at least one transverse member of the actuating frame such that extension and retraction of the linear actuator raises and lowers the bed; and wherein during raising of the bed frame from a low position to a high position the bed reaches a transition point and forces acting downward on the first articulated support and the second articulated support are applied to the first sliding hinge, the second sliding hinge, the third sliding hinge and the fourth sliding hinge, when the bed is raised above the transition point, and as the bed is lowered from the high position, the actuating frame contacts the first castor base and the second castor base when the bed reaches the transition point and the forces acting downward are shifted away from the first sliding hinge, the second sliding hinge, the third sliding hinge and the fourth sliding hinge to the actuating frame when the bed is below the transition point.

* * * * *